United States Patent [19]

Seijiro

[11] 4,149,717

[45] Apr. 17, 1979

[54] PUZZLE BOX

[75] Inventor: Kono Seijiro, Chiba, Japan

[73] Assignee: Kabushiki Kaisha A-One, Tokyo, Japan

[21] Appl. No.: 810,390

[22] Filed: Jun. 27, 1977

[30] Foreign Application Priority Data

May 30, 1977 [JP] Japan ..... 52-68470[U]

[51] Int. Cl.[2] ..... A63B 9/00

[52] U.S. Cl. ..... 273/1 R; 35/22 A; 273/157 R

[58] Field of Search ..... 273/1 R, 1 E, 1 M, 157 R; 35/22 R, 22 A

[56] References Cited

U.S. PATENT DOCUMENTS

| | | | |
|---|---|---|---|
| 2,623,303 | 12/1952 | Mindel | 35/22 A |
| 2,911,740 | 11/1959 | Miller | 35/22 A |
| 2,963,796 | 12/1960 | Zalkind | 35/22 A |
| 3,235,263 | 2/1966 | Smith | 273/1 R X |
| 3,565,425 | 2/1971 | Breslow | 273/1 R |
| 3,961,794 | 6/1976 | Goldfarb | 35/22 R X |

*Primary Examiner*—Paul E. Shapiro

*Attorney, Agent, or Firm*—Jacobi, Lilling & Siegel

[57] ABSTRACT

A puzzle box having a plurality of holes in its sides is provided. Players vie with other to see if they are able to put all the blocks in the box through said holes within a predetermined time. Said box is automatically opened to show the end of the game by a timer mechanism provided in the box.

15 Claims, 8 Drawing Figures

PUZZLE BOX

BACKGROUND OF THE INVENTION

The present invention relates to a puzzle box having side walls which are formed with holes for putting the blocks inside the box, and openable automatically and simultaneously upon the lapse of time preset for each play with a timer mechanism to inform players of the end of the game.

Though a variety of playing boxes have been marketed, the pleasure which players can obtain with conventional boxes is confined to seeing how to insert blocks of various shapes into the boxes.

Moreover, the holes of conventional puzzle boxes are often of a shutter type, so that the player's fingers are liable to be caught.

SUMMARY OF THE INVENTION

It is therefore an object of the present invention to provide a box for the insertion of blocks which affords more effects in various educational aspects by encouraging players to compete with each other in the speed of block selection and insertion with respect to any definite time preset with a timer.

Another object of the present invention is to provide a safe box for insertion of blocks in which all the side walls having holes for blocks are openable after a preselected period of time.

A further object of the present invention is to provide a box for insertion of blocks which can readily be stacked on another for storage.

In one aspect of the present invention, there is provided a puzzle box comprising a box body, at least one of whose walls including a plate perforated to provide holes which coincide with sections of a plurality of blocks having different shapes and at least one of whose walls including an openable plate; and a clockwork means mounted to a suitable position on said body to operate latch levers which are adapted to retain said openable plate.

In another aspect of the present invention, there is provided a puzzle box for use with a variety of playing blocks comprising; (a) a bottom plate; (b) a top plate; (c) a support means for supporting and interconnecting said bottom plate and said top plate with a spacing therebetween; (d) a plurality of side plates forming side walls of said puzzle box, at least one of said side plates being pivotably provided and normal urged to open outward and at least one of said side plates having a plurality of holes which coincide with sections of said playing blocks having different shapes; (e) a plurality of latch levers provided within said spacing and adapted to engage and hold said side plates in a closed position; (f) a clockwork means provided within said spacing for actuating said latch levers to take a release position; and (g) a setting means provided in said top plate but adapted to permit manual operation from outside the box for presetting the clockwork means to an appropriate time.

BRIEF DESCRIPTION OF THE DRAWINGS

Other objects and advantages of the present invention will become more apparent from the following detailed description when taken in conjunction with the accompanying drawings, in which.

DESCRIPTION OF THE PREFERRED EMBODIMENT

Figure 1:
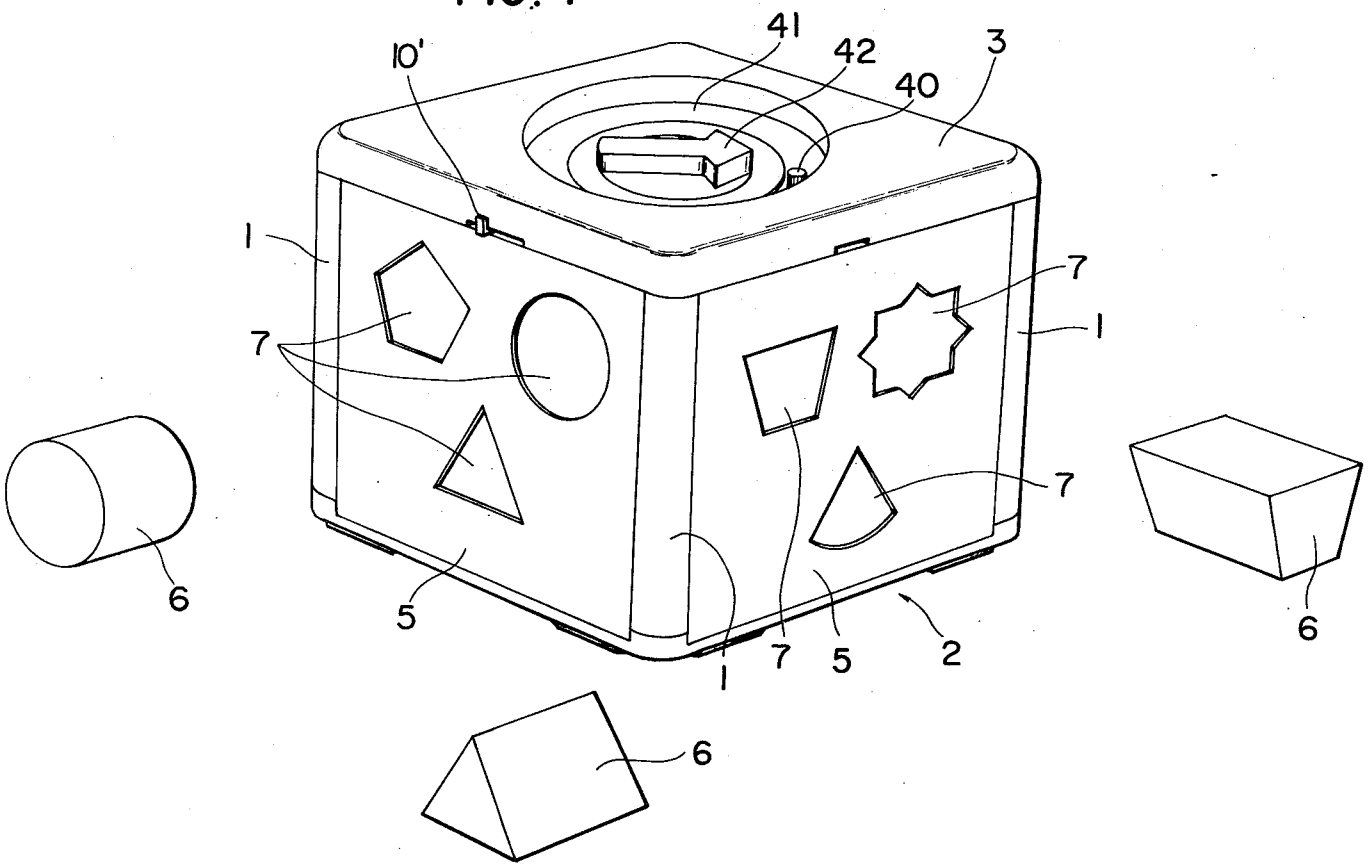
FIG. 1 is a perspective view of a puzzle box according to the present invention and blocks to be inserted into the box.
Figure 2:
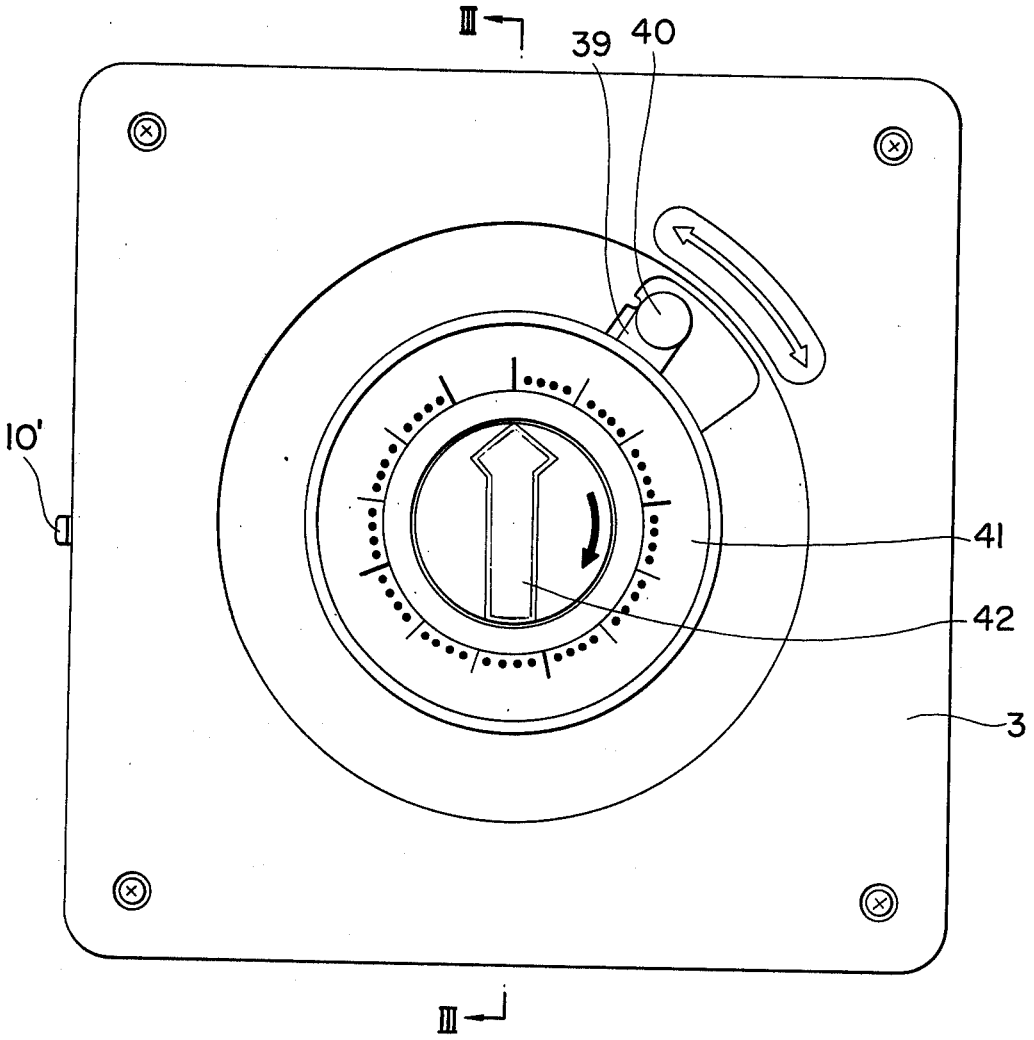
FIG. 2 is a plan view of the puzzle box.
Figure 3:
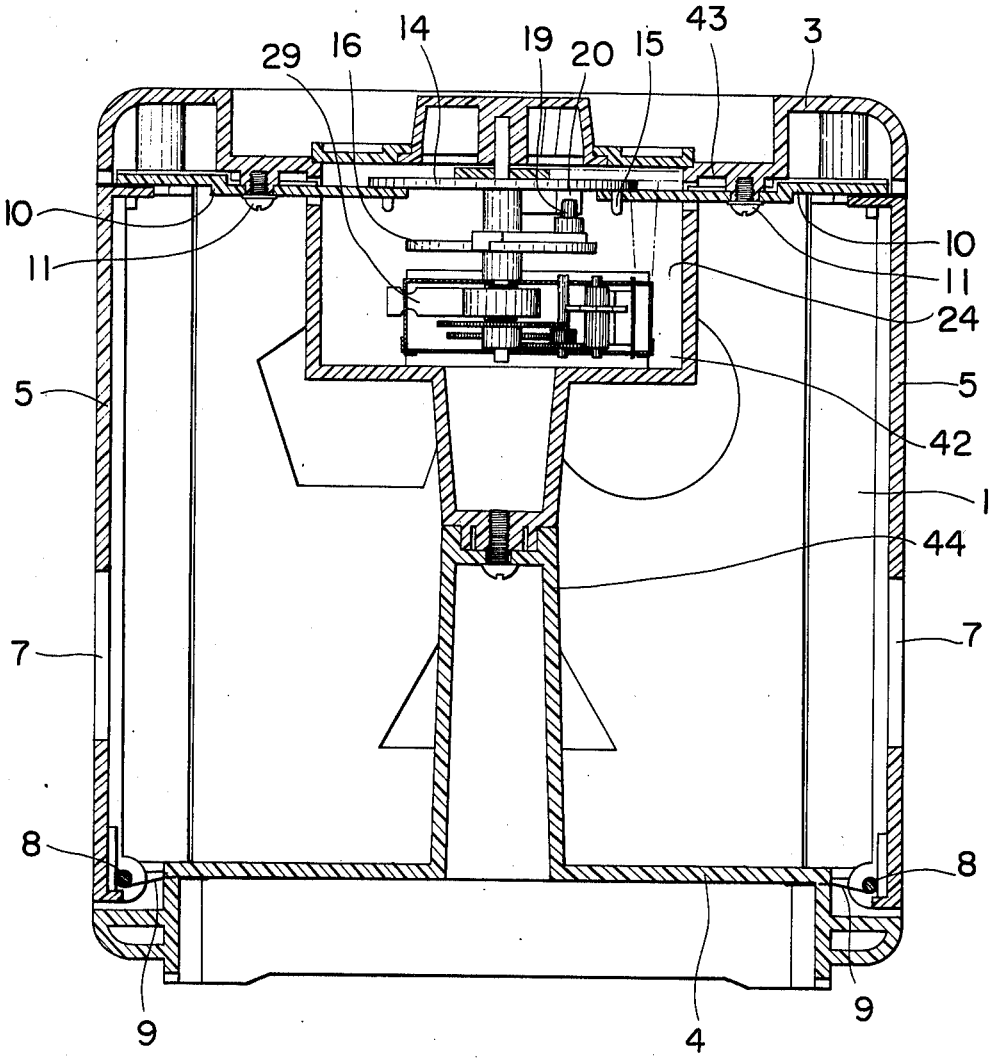
FIG. 3 is a vertical section taken on line III—III of FIG. 2.
Figure 4:
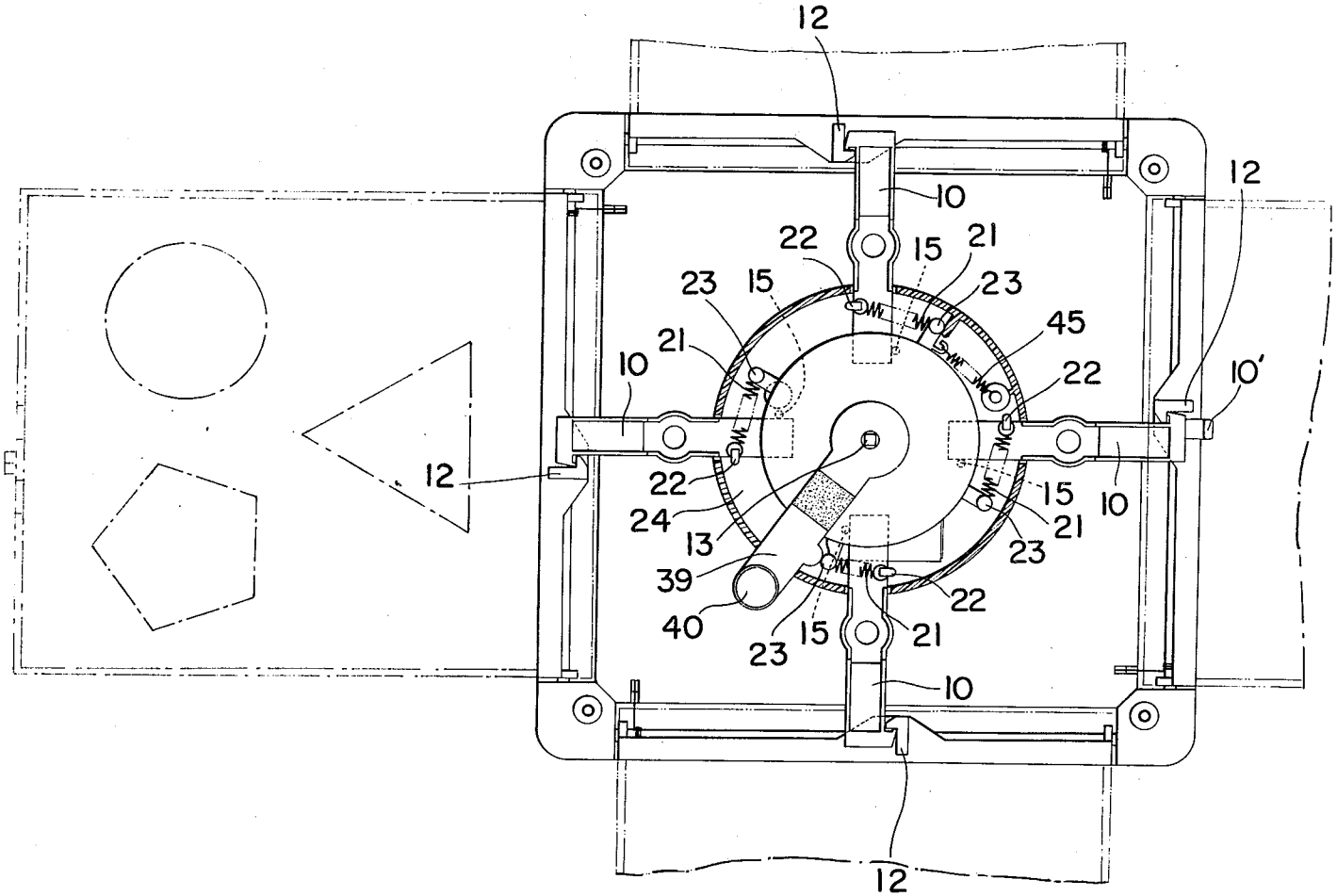
FIG. 4 is a plan view of a mechanism for opening and closing side walls of the box with a top plate removed.
Figure 5:
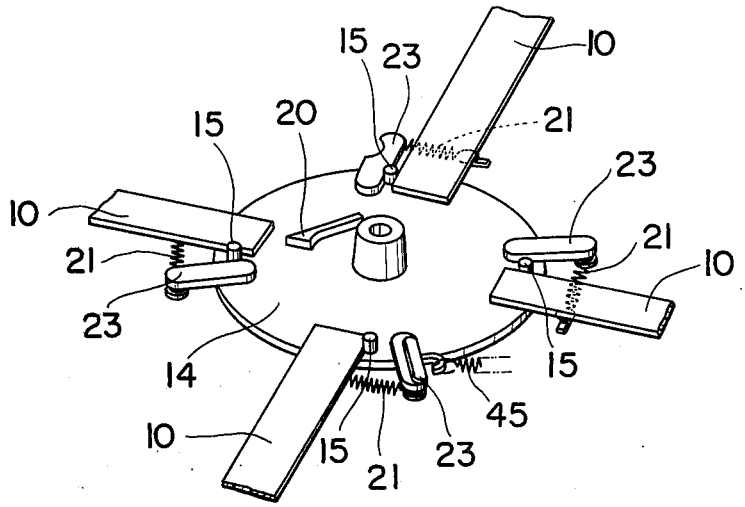
FIG. 5 is a perspective view of an interlocking mechanism on the bottom face of a rotatable disc.
Figure 6:
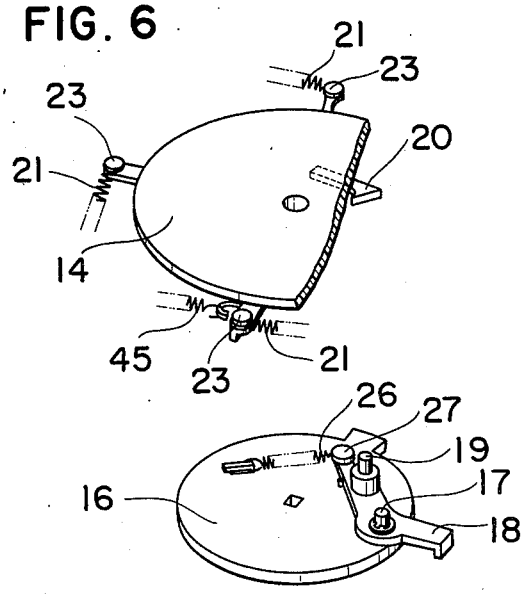
FIG. 6 is an exploded perspective view of an assembly of said rotatable disc and a cam disc.
Figure 7:
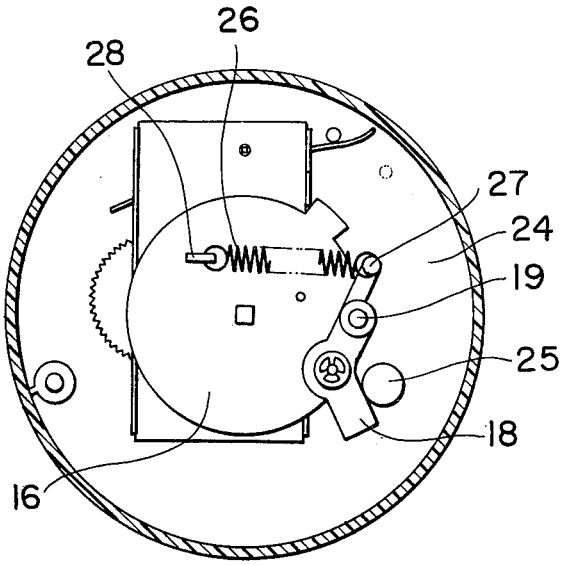
FIG. 7 is a plan view of the cam plate and lever.

Referring now to, FIGS. 1–8, a puzzle box generally designated by reference numeral 2 includes a framework comprising four upright corner posts 1 which interconnect and support a top plate 3 and a bottom plate 4 at their opposite ends. Four openable side plates 5 each having formed a plurality of holes 7 are connected at the lever ends to the posts 1 by means of pivot shafts 8 and respectively provided with springs 9. The holes 7 of the side plates 5 have various configurations which coincide with the sectional shapes of blocks 6. Latch levers 10 are mounted pivotably to the underside of the top plate by screws 11. Each of the latch levers 10 is at one end normally engaged with a hook portion 12 provided to the upper end of the side wall 5 and held at the other end in abutting engagement with a projection 15 extending downwardly from a rotatable disc 14, which is rotatably coupled over a shaft 13. The disc 14 carries on its underside a member 20 engageable with a lug 19 of a lever 18 which has two arm portions as shown and pivotably supported by a cam plate 16 through a pin 17. The latch levers 10 and the disc 14 are interconnected resiliently by springs 21 each being hooked to retainers 22 and 23 at opposite ends thereof. One arm of the lever 18 pivotable about the pin 17 is engageable with a stop member 25 extending vertically within a chamber 24 in which a spiral spring assembly is accommodated as will be described hereinafter. The other arm of the lever 18 is connected with the cam plate 16 through a spring 26 retained at opposite ends by projection 27 and hook 28.

A spiral spring 29 has one end thereof fixedly connected to the shaft 13 and rigidly fixed relative to the top plate while a gear 30 is mounted on the same shaft 13. The gear 30 is held in mesh with a small diameter gear 32 which is integral with a large diameter gear 31. The gear 31 is in constant mesh with a small diameter gear 34 which again is integral with a large diameter gear 33. Meshed with the gear 33 is a small diameter gear 36 rigidly carrying a star-shaped gear 35 therewith which is engaged with an oscillatable plate 37.

A control lever 39 movably mounted on the shaft 13 is formed with a projection 38 engageable with the oscilatable plate 37 and carries thereon a knob 40 which projects upwardly to juxtapose a plate 41. Suitable graduations are provided on the plate 41 to indicate time.

Designated 42 is a rotatable knob mounted to the upper end of the shaft 13.

The chamber 24 is contiguous with a recess 43 of the top plate 3 and the floor of the chamber 24 is fixed to the top of a pillar 44 integral with and extending upwardly from the center of the box floor 4.

At least one of the aforesaid latch levers 10 pivotted to the top plate 3 has such a dimension that its outermost end 10' is projected outwardly beyond the hook portion 12 of the corresponding side plate 5.

The box for use with playing blocks constructed as above described is operated as follows As a preliminary step, a player takes all the blocks 6 out of the box 2 and moves all the side plates 5 to their latched or closed positions whereupon he or she rotates the knob 42 on the top plate 3 to suitably indicate one of the graduations which the plate 41 bears, thereby rotating the shaft 13 to wind the spiral spring 29. Then, the player sets the knob 40 of the control lever 39 to a locking or stop position so that the projection 38 of the control lever 39 is brought into engagement with the oscillatable plate 37 to thereby restrain the movement of the plate. In this situation, all the gears 30, 31, 32, 33, 34 and gear 35 engaged with the plate 37 remain stationary and, therefore, the spiral spring 29 is prevented from unwinding.

Figure 8:
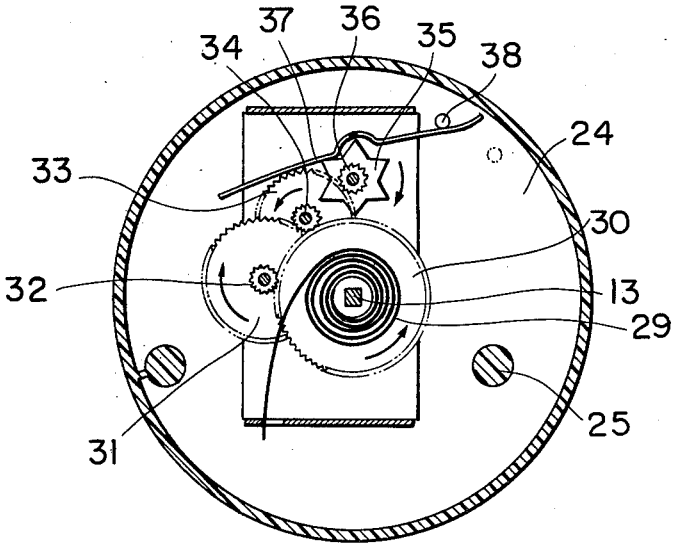
FIG. 8 is a plan view of gear train and noise generator including a spiral spring.

When now the knob 40 is moved to an unlocking or start position, the projection 38 of the control lever 39 is disengaged from the oscillatable plate 37 whereby the spiral spring is unwound in the direction indicated by an arrow in FIG. 8 causing the shaft 13 to rotate. The cam plate 16 fixed to the shaft 13 is then rotated together with this shaft. The rotation of the cam plate 16 is transferred to the disc 14 as the lug 19 provided to one arm of the lever 18 comes to abut against the member 20 carried on the underside of the disc 14. When the cam plate 16 is further rotated until the other arm of the lever 18 engages with the stop 25 standing in the chamber 24, the lever 18 is moved counter-clockwise about the pin 17 to have its projection 19 disengaged from the member 20 of the disc 14. Thereupon, the disc 14 having rotated together with the cam plate 16 is urged instantaneously back to its original position under the returning action of a spring 45 which has its opposite ends anchored to the peripheral wall of the chamber 24 and the edge of the disc 14. At the same time, the projections 15 of the disc 14 collide with one ends of the corresponding latch levers 10 whereby the latch levers are pivotted a small angular distance about their associated screws 11. This causes the other end of each latch lever 10 to disengage from the hook portion 12 of the corresponding side plate 5 so that all these plates are brought simultaneously to their open positions under the action of the springs associated with the shafts 8. The player is thus expected to put the blocks 6 of various shapes into the box through the appropriate holes 7 before the time expiry after which the side plates 5 open. A winner of the play is, for example, the one who succeeded in inserting the largest number of blocks within a preselected period of time. The latch levers 10 on the other hand are immediately returned to their original positions by the springs 21 hooked to the same levers and the disc 14, in which positions the latch levers are ready for engaging with the corresponding plates 5. Hence, after the play is over, the blocks will all be put in the box and the side plates 5 closed.

The provision of at least one latch lever 10 projecting out of the box as already mentioned is to faciliate manual opening of the corresponding side plate when needed. Any blocks left inadvertently outside of the box after the side plates are all closed can be put in the box by manually moving the outermost end 10' of said latch lever 10 so as to open the side plate corresponding to said latch lever.

While the star-shaped gear 35 is rotating in accordance with the unwinding of the spiral spring 29, the plate 37 is oscillated by the gear 35 producing a clattering sound which is effective to provide audible stimulat on to the player.

Furthermore, a plurality of such boxes can be readily and conveniently stored in a small space since all the members including the knob for winding the spiral spring are accommodated in the recess of the top plate to permit the boxes to be stacked one upon another.

It will now be appreciated from the foregoing that the present invention provides a very interesting plaything with which the player can match their abilities to select a suitable block and pass it through an appropriate hole in a side wall within a preset time.

What is claimed is:

1. A puzzle box comprising a box body, said body having one wall including a plate perforated to provide holes of different shapes adapted to receive therethrough blocks of corresponding shapes, and another wall including an openable plate movable between an open and a closed position; clockwork means mounted on said body; and latch means operatively connected to said clockwork means and said openable plate, said latch means serving to releasably maintain said openable plate in the closed position, and said clockwork means serving to release said latch means to enable said openable plate to be moved to the open positon.

2. A puzzle box according to claim 1, wherein said body is formed, at its upper portion, with a chamber for accomodating said clockwork means therein and a recess receiving therein a knob mounted on a winding stem of said clockwork means, whereby said knob and said clockwork means are disposed entirely below a horizontal plane defined by he top surface of said box body.

3. A puzzle box according to claim 1, wherein said openable plate has a hook portion, and said latch means comprises a latch lever with a tip end extending outwardly beyond the hook portion of said openable plate to permit its manual opening operation.

4. A puzzle box according to claim 1, wherein means are provided to urge said openable plate to the open position.

5. A puzzle box for use with a variety of playing blocks comprising:

(a) a bottom plate;

(b) a top plate;

(c) support means for supporting and interconnecting said bottom plate and said top plate with a spacing therebetween;

(d) a plurality of side plates forming side walls of said puzzle box, one of said side plates being pivotably movable and normally urged to open outwardly and another of said side plates having a plurality of holes of different shapes adapted to receive therethrough playing blocks of corresponding shapes;

(e) a latch lever provided within said spacing and adapted to engage and hold said one side plate in a closed position;

(f) clockwork means provided within said spacing for moving said latch lever to a release positon after a predetermined time; and (g) a setting means provided on said top plate and manually operable from outside the box for presetting the clockwork means to an appropriate time.

6. A puzzle box according to claim 5, wherein said top plate has a recessed portion at a center portion of the upper surface thereof, said clockwork means being attached to the bottom of said recessed portion.

7. A puzzle box according to claim 6, wherein the setting means is accommodated in said recessed portion and disposed on top of the clockwork means.

8. A puzzle box according to claim 7, wherein said clockwork means includes a shaft, a spring attached to said shaft at its one end and rigidly connected at its other end relative to the bottom of the recessed portion thereby to be wound up around by said shaft, and a transmitting means for transmitting a motion created by the unwinding of said spring to actuate said latch lever.

9. A puzzle box according to claim 8, wherein said setting means includes a dial having an opening in its center portion through which the shaft of said clockwork means protrudes upwardly, and an arrow-shaped knob attached to the tip of said shaft, whereby a player can set the clockwork means to an appropriate time.

10. A puzzle box according to claim 6, wherein said recessed portion has through holes on its peripheral wall; the latch lever being pivotally connected to a substantially peripheral portion of the top plate at its intermediate portion from inside the box, passing through one of said through holes at its one end to be actuated by the clockwork means, and being adapted, at its other end, to engage the upper edge of the one side plate.

11. A puzzle box according to claim 5, wherein said latch lever projects, at its tip, to the outside of the box to permit normal opening of the one side plate.

12. A puzzle box according to claim 5, wherein said support means include a plurality of corner posts interconnecting the top plate and the bottom plate.

13. A puzzle box according to claim 5, wherein said support means includes a column interconnecting the top plate and the bottom plate at their respective center portions.

14. A puzzle box according to claim 5, wherein each side plate is pivotally attached at its lower edge to the bottom of the box.

15. A puzzle box according to claim 14, wherein a hair spring is provided, one end of said spring reacting against the bottom plate and the other end thereof reacting against the one side plate to urge said one side plate to open outwardly.

* * * * *